US007357239B2

(12) United States Patent
Schwarzli et al.

(10) Patent No.: US 7,357,239 B2
(45) Date of Patent: Apr. 15, 2008

(54) VENDING MACHINE TRACKING SYSTEM

(75) Inventors: Josef W Schwarzli, Stouffville (CA); Bernard R. Schwarzli, Mount Albert (CA); Jens Ronneberger, Brighton (CA)

(73) Assignee: Beaver Machine Corporation, Newmarket, Ontario (CA)

( * ) Notice: Subject to any disclaimer, the term of this patent is extended or adjusted under 35 U.S.C. 154(b) by 207 days.

(21) Appl. No.: 10/505,423

(22) PCT Filed: Feb. 25, 2003

(86) PCT No.: PCT/CA03/00263

§ 371 (c)(1),
(2), (4) Date: Apr. 15, 2005

(87) PCT Pub. No.: WO03/071496

PCT Pub. Date: Aug. 28, 2003

(65) Prior Publication Data

US 2005/0173222 A1 Aug. 11, 2005

(30) Foreign Application Priority Data

Feb. 25, 2002 (CA) ..... 2372995

(51) Int. Cl.
*G07F 5/02* (2006.01)

(52) U.S. Cl. ..... 194/239; 200/DIG. 3

(58) Field of Classification Search ..... 453/239, 453/243, 247, 249, 250, 251, 253; 194/239, 194/243, 247, 249, 250, 251, 253, 229–232, 194/234–236, 300; 200/DIG. 3
See application file for complete search history.

(56) References Cited

U.S. PATENT DOCUMENTS

| | | | | |
|---|---|---|---|---|
| 1,154,381 | A * | 9/1915 | Corbet | 194/251 |
| 2,132,253 | A * | 10/1938 | Wirt | 194/239 |
| 2,292,965 | A * | 8/1942 | Osborne | 194/219 |
| 3,559,788 | A | 2/1971 | Jensen et al. | |
| 3,776,338 | A | 12/1973 | Johnson | |
| 4,199,669 | A * | 4/1980 | Vogt | 200/52 R |
| 4,412,292 | A | 10/1983 | Sedam et al. | |
| 5,909,795 | A | 6/1999 | Porco et al. | |
| 5,924,542 | A * | 7/1999 | Schwarzli | 194/236 |
| 5,950,794 | A | 9/1999 | Porco et al. | |
| 5,954,181 | A | 9/1999 | Schwarzli | |
| 6,050,385 | A | 4/2000 | Nikolayev et al. | |

(Continued)

FOREIGN PATENT DOCUMENTS

DE 2 349 786 12/1974

(Continued)

*Primary Examiner*—Patrick Mackey
*Assistant Examiner*—Mark J. Beauchaine
(74) *Attorney, Agent, or Firm*—Dimock Stratton LLP; Mark B. Eisen

(57) ABSTRACT

A tracking system counts events in the operation of multiple machines or devices over a wide geographic area. For example, for bulk venders the system counts each vend responsive to rotation through a cycle of the coin mechanism, and preferably records the date and time of each vend. An active tag has a memory for storing data representing a vending event, for example the date and time of the event. The data is periodically read by an interrogator, which downloads the data stored in the tag memory and erases the memory to reset the tag for continued monitoring of the vender. With this information an operator can reconcile revenues, track when sales take place and over what period of time, and track the work habits of service personnel.

7 Claims, 3 Drawing Sheets

U.S. PATENT DOCUMENTS

| | | | |
|---|---|---|---|
| 6,062,370 | A | 5/2000 | Nikolayev et al. |
| 6,290,049 | B1 | 9/2001 | Nikolayev |

FOREIGN PATENT DOCUMENTS

| | | | |
|---|---|---|---|
| DE | 44 37 813 | A1 | 4/1996 |
| DE | 196 18 962 | A1 | 11/1997 |
| DE | 196 13 716 | C1 | 12/1997 |
| EP | 0 986 033 | A2 | 3/2000 |
| FR | 2 744 282 | A1 | 8/1997 |
| WO | WO/03/071496 | A2 | 8/2003 |

* cited by examiner

VENDING MACHINE TRACKING SYSTEM

FIELD OF INVENTION

This invention relates to vending machines. In particular, this invention relates to a system for tracking vending machines and vended merchandise.

BACKGROUND OF THE INVENTION

Bulk venders, colloquially known as "gum ball machines", are widely used for dispensing confectioneries and other small articles of merchandise. A typical bulk vender has a hopper assembly comprising a transparent globe which functions as a merchandise storage bin, seated over a dispensing wheel which revolves in a hopper. A patron deposits the required coinage into the coin mechanism and turns the handle, which rotates the dispensing wheel to convey a preset amount of merchandise to the dispensing chute. The hopper assembly is located over a body which is mounted on a base, defining a secure compartment containing a cash box into which the coin mechanism ejects the deposited coins.

Bulk venders are typically purchased and maintained by vender operators, who install and service the venders at high traffic locations such as shopping malls, restaurants and the like. The operator periodically restocks the venders and collects the proceeds from the sale of articles dispensed by the venders, and typically remits a portion of the proceeds to the owner of the premises. A large vender operator may operate many hundreds of bulk venders, employing service personnel to service the venders and deliver the coins which have accumulated within the cash box to the operator.

Bulk venders are intended particularly for use in unsupervised public areas, and as such are designed to resist tampering, theft and vandalism by patrons. However, since in a conventional bulk vender the number of articles dispensed from each vender is not monitored, so that the vender operator can never know how many coins should be collected from any particular vender during a service call, the operator is highly vulnerable to the theft of coins by the operator's service personnel. The operator can also be vulnerable to the substitution of slugs for coins by service personnel before the collected coins are delivered to the operator.

In either case the operator's proceeds can be significantly reduced. This significantly limits an operator's ability to expand his or her business because the operator is either limited to using only employees known to be trustworthy, or runs the risk of substantial losses due to skimming by employees. Further, this reduces the operator's ability to account to the owner of the premises on which a vender is located, because the operator can never be certain when remitting a portion of the proceeds to the owner of the premises that all monies collected by the vender have been accounted for.

Moreover, because bulk venders are designed for self service by users with minimal maintenance, they are frequently placed in locations where their use cannot be readily supervised. As a result bulk venders are readily susceptible to theft, and when recovered the authorities may have no way of identifying the operator/owner of the vender. Also, occasionally a vender may be abandoned by its operator, or for some reason the operator may have to be notified regarding a problem with the vender, and there is occasionally no easy way to identity the owner of the vender.

SUMMARY OF THE INVENTION

The present invention overcomes these disadvantages by providing a tracking system for any coin-operated machine or device, including for example bulk venders. In the preferred embodiment the system of the invention counts each vend responsive to a cycle of the coin mechanism, and records the date and time of each vend.

The invention accomplishes this by providing an active tag, in the form of a microchip disposed in a housing, which has a memory for storing data representing a vending event, for example the date and time of the event. The data is periodically read by a hand-held reader or "interrogator," which downloads the data stored in the tag memory and erases the memory to reset the tag for continued monitoring of the vender. With this information an operator can reconcile the number of coins collected from the vender with the number of vends recorded, to ensure that the operator's proceeds are not being stolen by employees. The presence of the tag would inhibit theft to such an extent that an operator would no longer have to limit the expansion of his or her business because a much greater pool of potential employees becomes available to the operator, which significantly increases the number of venders that the operator can service.

The recorded information also allows an operator to determine when the vender is likely to need restocking, to thereby anticipate servicing requirements; to track when vends take place and over what period of time, to help in determining the commercial viability of a vender location; and to track the work habits of service personnel and determine their operating efficiency.

In the preferred embodiment the tag transmits the data via a radio frequency (RF) signal, has a unique identification code, and operates responsive to a digital key which allows only a reader having a corresponding key to task the tag for data and erase its memory. Thus, the tag not only monitors the activity of the coin-operated machine or device, but also provides an instant indication as to the identity of the owner/operator.

The tag may comprise, or be a component of, a "microelectromechanical system" or "MEMS." Such a device is capable of providing a tag identification function, data memory, mechanical power generation and storage, RF communications, coin sensing/vend actuation, and event capture where the event may be a vend, a temperature or moisture alarm, etc., and data transfer.

In a further preferred embodiment the interrogator 100 can be provided with wireless communications capabilities and/or a GPS or GSM transponder, allowing the operator to track the whereabouts of service personnel.

In other applications, for example for tracking revenues and other events relating to taxicabs, the device of the invention can be connected to existing counting circuitry to record events as they occur. The invention has application to other industries where it may be advantageous to track events in the life of a product or service, for example in food processing and post-processing activities, for example storage and shipping, for quality control and consumer safety.

The present invention thus provides a tracking system comprising a tag having a memory containing an identification code, an RF transceiver for receiving instructions from an interrogator and transmitting data to the interrogator, and an erasable memory for storing vending event data; whereby the event data received from one or more sensors is recorded by the tag and when the tag is read by the interrogator, the event data is transferred to the tag and the memory is erased.

In further aspects of the tracking system: the system comprises a clock, wherein the event data comprises the date or time, or both, of each event; the event data comprises temperature data; the event data comprises moisture or humidity data; the event data is stored in a non-volatile memory; during data transfer the tag derives power from an electromagnetic field generated by the interrogator; the memory further comprises and at least one digital key such that the tag transmits data only to an interrogator possessing the key the interrogator is provided with a Global Positioning System (GPS) transponder or a Global System for Mobile communications (GSM) transponder for periodically indicating a position of the interrogator; and the interrogator is provided with a mobile telephone for communicating with a central station.

The invention further provides a vender comprising a merchandise storage portion and a coin mechanism having a handle exposed for rotation, whereby a selected amount of merchandise is dispensed with each rotational cycle of the coin mechanism, having a tracking system comprising a tag having a memory containing an identification code and at least one digital key, an RF transceiver for receiving instructions from an interrogator and transmitting data to the interrogator, and a RAM for storing vending event data; and an interface for incrementally increasing a vend count stored in the RAM with each rotation of the coin mechanism.

In further aspects of the vender: the vender comprises a clock, wherein the vending event data comprises the date or time, or both, of each vend; the vending event data comprises a code representing the type of merchandise being dispensed; the interface comprises a dog disposed on a pivot, being biased to one of open and closed positions and having on each side of the pivot an upstanding finger in the path of the coin, and a contact housing positioned with contacts facing a conductive one of the fingers, whereby as the coin passes one finger it pushes the dog to the closed position to close a circuit and generate a count pulse in the tag, and as the coin passes the other finger it pushes the dog to the open position remote from the contacts; and the dog is biased by a spring-loaded ball which settles into one of two notches under the force of spring.

The invention further provides a switch for transmitting an electrical signal to a tracking tag associated with a rotary coin mechanism, comprising a dog disposed on a pivot, being biased to one of open and closed positions and having on each side of the pivot an upstanding finger in the path of the coin, and a contact housing positioned with contacts facing a conductive one of the fingers, whereby as the coin passes one finger it pushes the dog to the closed position to close a circuit and generate a count pulse in the tag, and as the coin passes the other finger it pushes the dog to the open position remote from the contacts.

In a further a aspect of the switch, the dog is biased by a spring-loaded ball which settles into one of two notches under the force of a spring.

BRIEF DESCRIPTION OF THE DRAWINGS

In drawings which illustrate by way of example only a preferred embodiment of the invention.

DETAILED DESCRIPTION OF THE INVENTION

Figure 1:
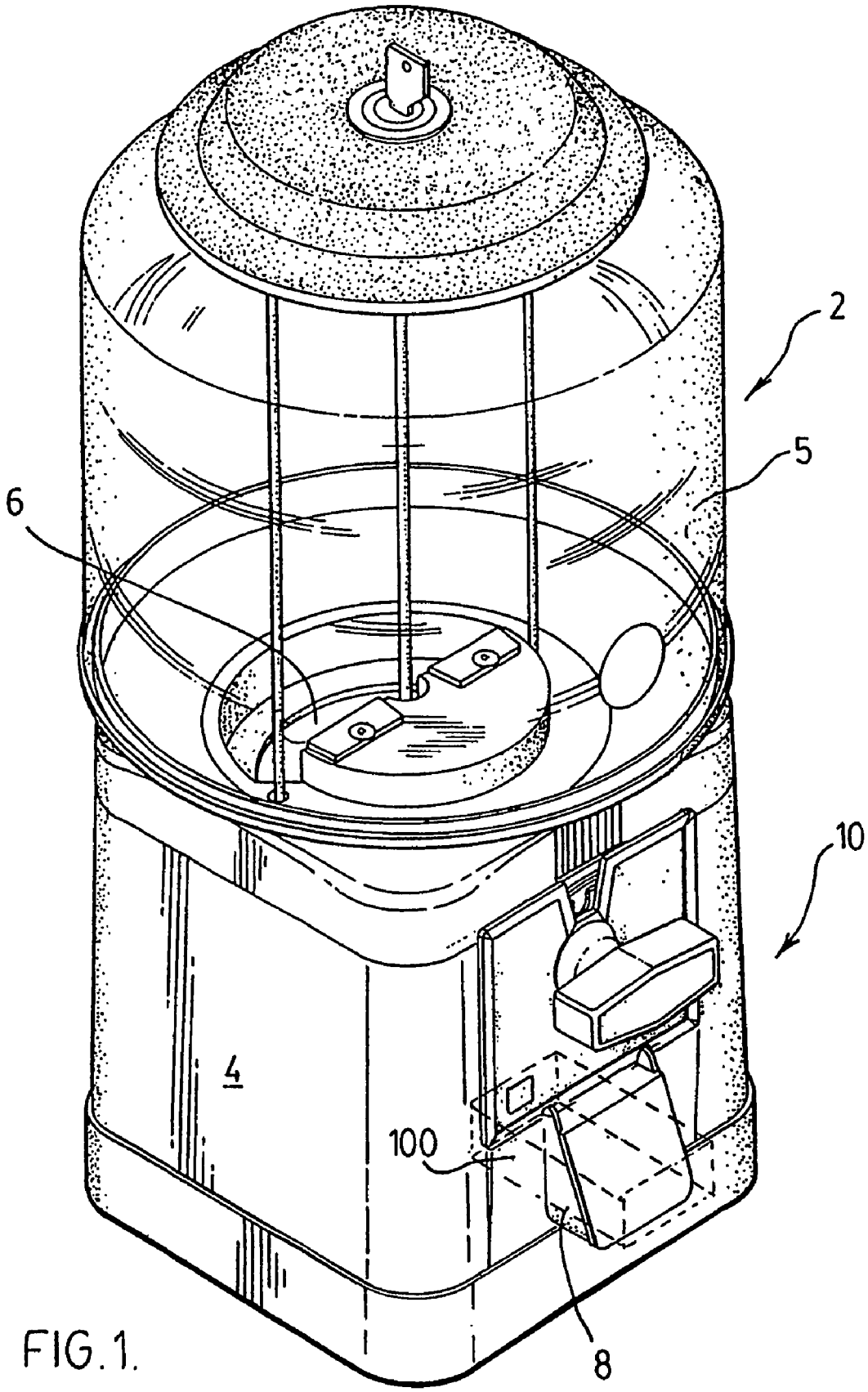
FIG. 1 is a perspective view of a bulk vender embodying the invention.

FIG. 1 illustrates a typical bulk vender 2 in which the system of the invention may be employed. The vender 2 conventionally includes a lower housing 4 enclosing the workings of the coin mechanism 10 and a cash box (not shown) for collecting deposited coins or tokens 1, a transparent article storage bin 5 for storing merchandise such as gum balls or other articles to be dispensed, and a turntable 6 which is rotated by rotation of the coin mechanism 10 to align one of a plurality of product conveyors with the opening to a dispensing chute 8, as is well known. A vender of this type is described and illustrated in U.S. Pat. No. 5,954,181 for a "Coin Mechanism with Magnetic Locking System" issued on Sep. 21, 1999, which is incorporated herein by reference. It will be appreciated that this is merely one example of a bulk vender in which the invention can be implemented, and the description thereof is not intended to be limiting.

Although the invention will be described with reference to a coin, the term "coin" as used herein includes coins and tokens and like elements, and is in no way restricted to currency or coins having a monetary value. Further, while the invention is described herein in the context of a coin mechanism 10 in a bulk vender 2, it will also be understood that a coin mechanism of the invention may be used in any other machine or device which operates responsive to a coin mechanism, including many types of machines and devices which do not dispense merchandise such as parking meters, laundry machines and video games, by way of non-limiting example, and the invention is accordingly not restricted to any particular type or application of the coin mechanism. The invention is advantageously implemented where multiple machines or devices are placed in locations that do not provide ready access to a mains electrical power supply, and are spread out over a wide geographic area, bulk venders 2 being merely one example.

In each vending machine or device 2 a complete cycle of the coin mechanism is referred to herein as a "vend," whether the coin mechanism cycle causes merchandise to be dispensed, time on a parking meter to increase, a washing machine to complete a wash cycle, a video game to go into play mode, or otherwise.

Figure 2:
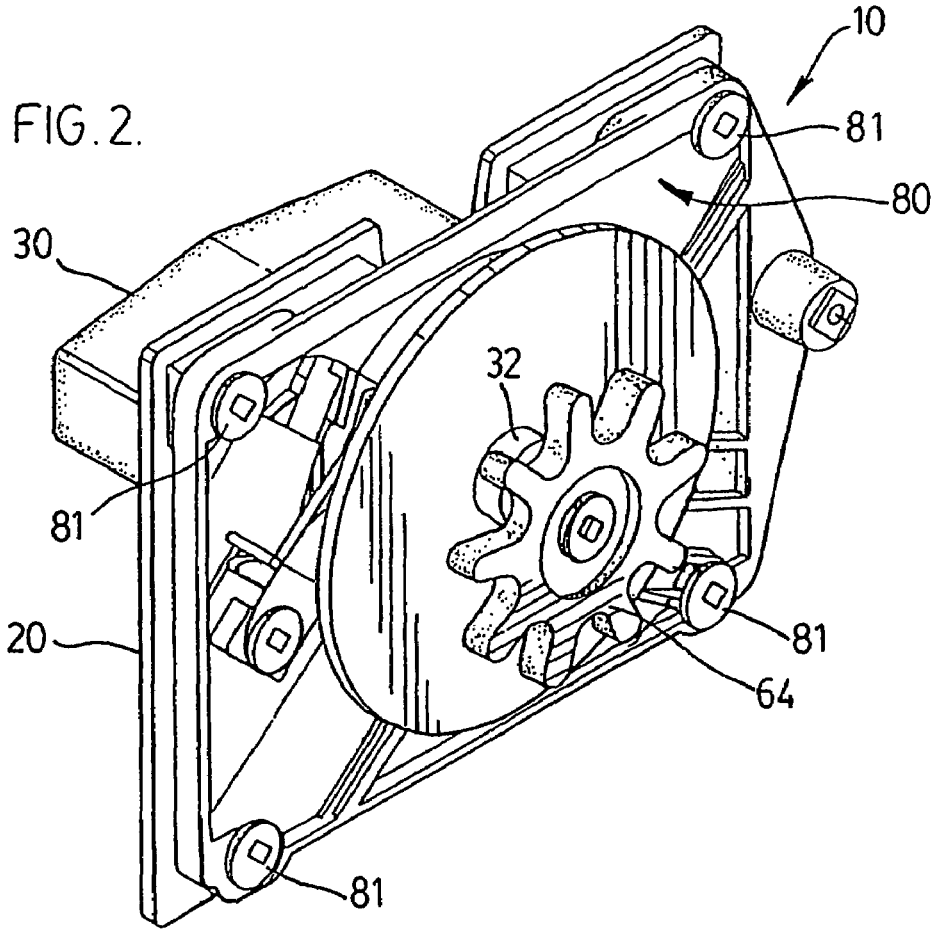
FIG. 2 is a rear perspective view of a coin mechanism embodying the invention in a bulk vender.
Figure 3:
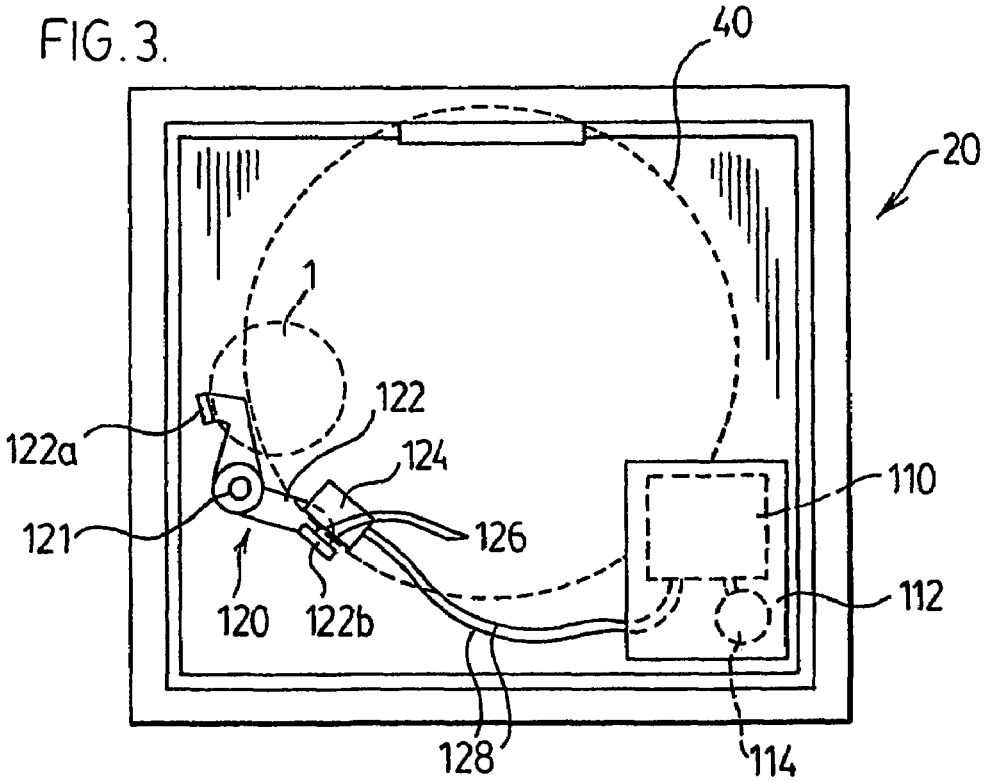
FIG. 3 is a rear elevation of the cover plate of the coin mechanism of FIG. 2.

FIGS. 2 and 3 illustrate a preferred embodiment of a coin mechanism 10 embodying the invention in a bulk vender 2. The mechanism 10 comprises a cover plate 20 having a coin opening 24. A handle 30 is fixed to a tapered shaft 32 which extends through an opening formed by a nipple 26 projecting from the cover plate 20 and engages an opening 38 disposed through the centre of a substantially disc-shaped coin conveyor 40. The shaft 32 has a longitudinal flat (or slightly concave) surface 32*a* allowing it to rotationally engage the coin conveyor 40.

The coin conveyor 40 includes a coin receiving portion for receiving a coin 1 which comprises a recess 42 formed to the size of the intended coin 1, in which the coin 1 nests as it is conveyed about the rotational cycle of the coin mechanism 10. In the illustrated embodiment the coin conveyor 40 is provided with peripheral ratchet teeth 41 which cooperate with a pawl to prevent reverse rotation of the mechanism 10 during most of the rotational cycle (a small radius of reverse rotation is permitted immediately beyond the rest position, which allows the coin conveyor 40 to revert to the rest position if the measuring devices reject the deposited coin).

A back plate 80 overlays the coin conveyor 40 and is affixed to the cover plate 20 so as to be stationary relative thereto, as by bolts 81. The back plate 80 retains a coin 1 in the coin recess 42 along the rotational path followed by the coin 1 as the handle 30 is rotated. The shaft 32 extends through an opening 86 in the back plate 80 and is rotationally engaged to a dispensing gear 64 for rotating the turntable 6. Thus, the cover plate 20 and back plate 80 remain stationary, while the coin conveyor 40 and gear 64 are fixed in position on the shaft 32 and rotate as the handle 30 is turned.

A dog 70 for measuring the thickness of a coin 1 may be mounted on the back plate 80 biased against the coin recess 42 by a spring 70*a*, to catch the trailing edge of the coin recess 42 if a deposited coin or slug is thinner than the intended coin 1 and arrest rotation of the mechanism 10. Conventionally a diameter measuring dog 34 for measuring the diameter of the coin 1 is pivotally mounted on the cover plate 20, biased against the coin conveyor 40 by a spring 34*a*, to catch on the trailing corner 35 of the coin recess 42 if a deposited coin or slug has a diameter smaller than the intended coin 1 and thus arrest rotation of the mechanism 10. The coin conveyor 40 thus conveys the proper coin 1 to the coin ejection ramp 25, where it falls into a coin tray (not shown) concealed within the vender housing 4, along a specific rotational path that allows the measuring dog 34 to measure the coin 1 at the designated radial position. If a deposited coin or slug is not of the correct size, the dog 34 cooperates with the coin conveyor 40 to arrest rotation of the mechanism 10.

According to the invention, a tag is provided to record vending events. The tag may be a radio frequency identification (RF ID) tag 110, which comprises a ROM containing a non-erasable identification code and at least one digital key, along with any necessary operating software; an RF transceiver for receiving instructions from a reader or "interrogator" 100 (shown in phantom in FIG. 1) and transmitting data to the interrogator 100; a clock; and a RAM for erasably storing vending activity data, in the preferred embodiment representing the date and time of each complete revolution of the coin mechanism 10, and optionally the type of merchandise with which the vender 2 is stocked, and the temperature and/or humidity of the environment in which the vender 2 is located; all integrated into a single chip. Such RF ID tags are commercially available for use with electronic devices, for example for recording temperature measurements from an electronic thermometer or thermostat. An example of a suitable tag 100, without limitation, is any tag operating at 13.56 MHz and meeting the ISO 18000-3/15693 protocol or similar protocols.

In the preferred embodiment, the tag 110 is hermetically sealed in a housing 112 along with a power source 114, for example a commercially available compact lithium battery. The battery 114 may operate at an output of a few microamps and a voltage at or below 3.3 V, which is sufficient to operate the tag 110. The tag 110 is preferably disposed between the cover plate 20 and back plate 80, positioned so that the tag transceiver is capable of communicating with the interrogator 100 positioned in front of the coin mechanism 10, as shown in FIG. 1. If necessary the portion of the cover plate 20 overlaying the tag 110 can be reduced in thickness, or a non-metallic insert can be affixed into the cover 20 over the tag 110, to create an RF "window" which allows the tag transceiver to communicate with the interrogator 100.

The RF signal from the tag 110 should be kept at a fairly low power, to conserve energy and ensure that if venders are in close proximity to one another, data is being retrieved only from the vender being interrogated. Thus, the interrogator 100 must be held fairly close to (for example, within 10 cm), or in contact with, the cover plate 20 of the coin mechanism 10. The interrogator 100 may comprise a standard Personal Digital Assistant (PDA) that provides a port for connecting an accessory reader, and the software (which may be programmed over any standard operating platform) can be downloaded to the PDA or provided in an accessory card. Suitable PDA and other reading devices are currently available.

According to the invention, an interface 120 is provided to recognize the motion of the coin mechanism turning through a complete cycle—which is representative of a single vending event—and generate a pulse which incrementally increases the vend count in the tag 110 and preferably records the date and time of the vending event. In one preferred embodiment shown in FIG. 3, the interface 120 may comprise a metallic dog 122 having at each end an upstanding finger 122*a*, 122*b* in the path of a coin 1. A contact box 124 is positioned with contacts 126 facing the finger 122*b*, so that as the coin 1 passes the finger 122*a* it pushes the finger 122*b* against the contacts 126 to thus close a circuit through wires 128 and generate a count pulse in the tag 110. As the coin passes the finger 122*b* it pushes the finger 122*b* away from the contacts 126. The dog 122 is preferably frictionally engaged to a hub 121, so that it will not slip between the open and closed positions if the machine is shaken or subjected to vibration.

Figure 4:
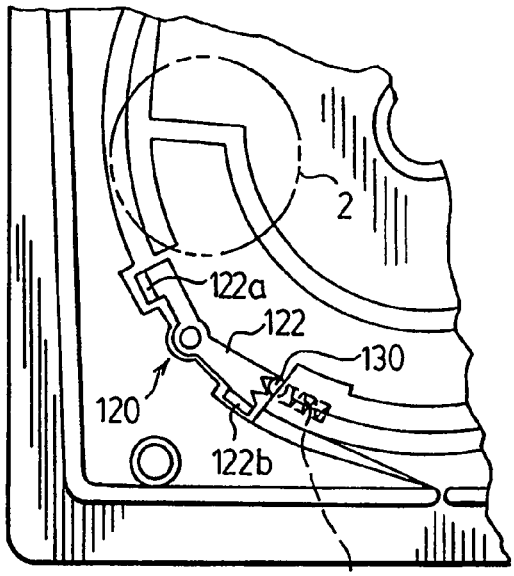
FIG. 4 is an enlarged elevation of a switch for pulsing the tag to signal a vending event.
Figure 5A:
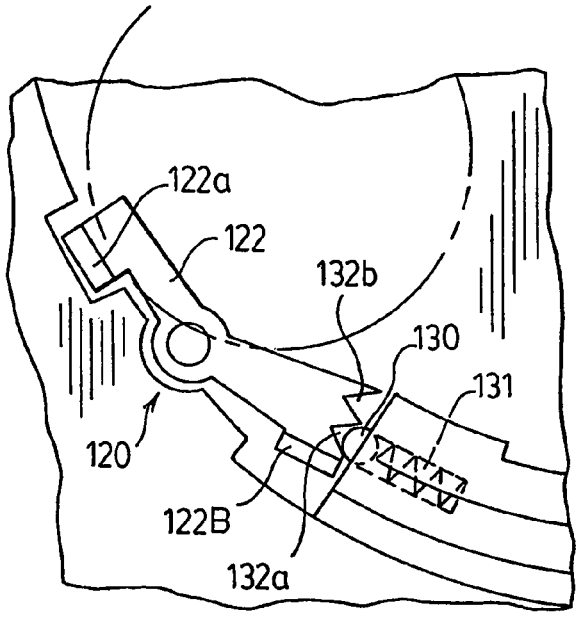
FIG. 5A is an enlarged elevation of a dog in the switch of FIG. 4, showing the dog in position adjacent to the switch contacts
Figure 5B:
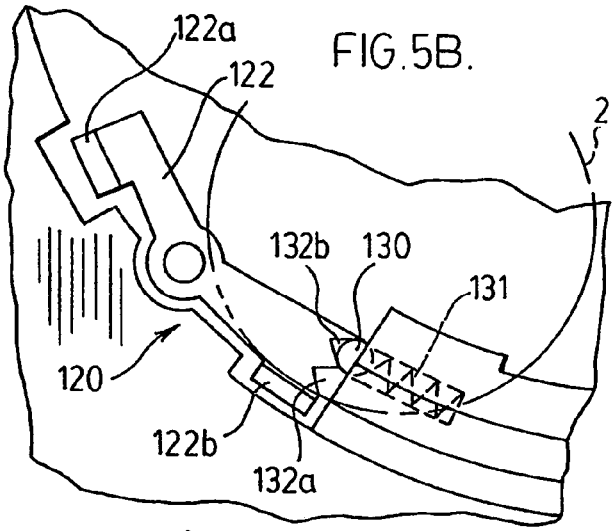
FIG. 5B is an enlarged elevation of the dog in FIG. 5A, showing the dog in position remote from the switch contacts.
Figure 6A:
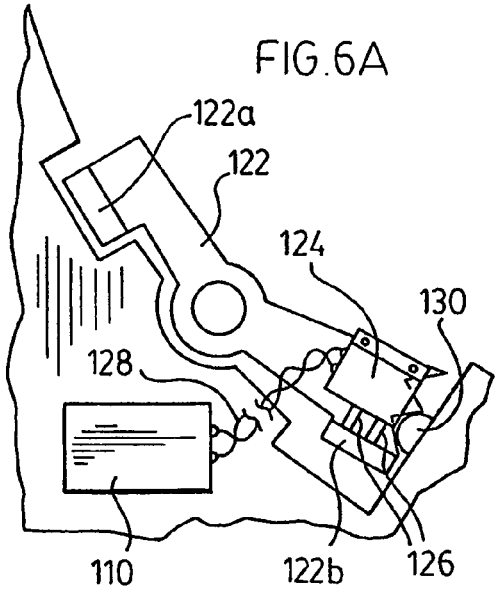
FIG. 6A is an enlarged elevation of the switch of FIG. 4, showing the switch in a closed position.
Figure 6B:
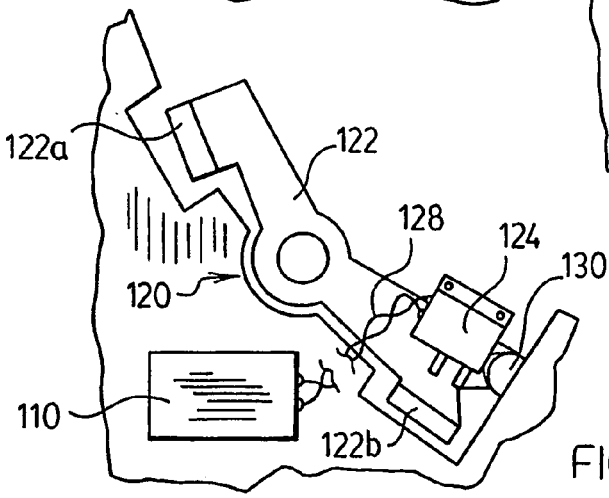
FIG. 6B is an enlarged elevation of the switch of FIG. 6A, showing the switch in an open position.

In this embodiment, it is important to ensure that the counter or tag 110 counts only once with each vend of the vending machine, the switch that pulses the counter or tag must do so only once during each complete cycle of the coin mechanism 10, which is representative of a single vending event. This incrementally increases the vend count in the counter or tag 110 by a unit, and optionally records the date and time of the vending event. In the preferred embodiment shown in FIGS. 4 to 6, the switching interface 120 comprises a dog 122 having at each end an upstanding finger 122*a*, 122*b* in the path of a coin 1. The finger 122*b* is conductive or has a conductive coating applied to it. A contact housing 124 (shown in FIG. 6) is positioned with contacts 126 facing the finger 122*b*, so that as the coin 2 passes the finger 122*a* it pushes the finger 122*b* against the contacts 126 to thus close a circuit through wires 128 and generate a count pulse in the tag 110. As the coin passes the finger 122*b* it pushes the finger 122*b* away from the contacts 126. The switch dog 122 is biased to either the open ("off") or closed ("on") position, for example by a spring-loaded ball 130 which settles into either notch 132*a* or notch 132*b* under the force of compression spring 131, depending upon the position of the dog 122, but does not allow the dog 122 to freely move between the on and off positions. The dog 122 can thus contact the contacts 126 only once with each coin 2 that passes the fingers 122*a* and 122*b*, to thus ensure a single pulse is delivered to the tag or counter 118. The wiring connections for creating this circuit (not shown) will be apparent to those skilled in the art.

Alternatively, the interface 120 may comprise a proximity sensor actuated by a density differential, reflective surface or other proximity actuator on the coin conveyor 40; a reed switch responsive to a magnet embedded in the coin conveyor; or some other activating interface which closes a circuit to generate a pulse on the event input pin of the tag 110. In each case the interface 120 is located at a position in the rotational cycle of the coin mechanism 10 at which the coin has already been accepted, so that the tag 110 does not falsely count partial rotations through the free-turning portion of the beginning of the coin mechanism cycle as actual vends.

In operation, the vender 2 is set up in the selected location and the storage bin 5 is stocked with merchandise. The interrogator 110 is positioned as shown in FIG. 1, and activated to signal the tag 110 to switch out of 'sleep' (power saving) mode and transmit its identification code. If this is the first interrogation, the interrogator 100 is initialized to the tag 110, i.e. the operator key stored in ROM in the tag 110 is then programmed into the interrogator 100 and will thereafter be recognized by the interrogator 100. (Alternatively, the operator key can be preprogrammed into the interrogator 100 by the manufacturer as a recognized key). The identification code is retrieved by the interrogator 100 and the service person enters the location of the vender 10 into the interrogator 100 via an alpha-numeric keypad (not shown). Thereafter, each time the coin mechanism 10 is rotated through a complete cycle, the cam 120 passes the switch 122 and the tag 110 counts another vend, and preferably associates with the vend event data representing the date and time of the vend.

Periodically, service personnel interrogate the tag 110 using the interrogator 100, and retrieve the data stored in RAM. The interrogator 100 is used to signal the tag 110 to switch out of 'sleep' mode and transmit its identification code. If the operator key is recognized by the interrogator 100, the identification code is retrieved by the interrogator 100 along with the data representing vend events, which may include the date and time of a vend, and if desired a code representing the type of merchandise being dispensed. When the data retrieval is complete, the interrogator 100 signals the tag 110 to erase its RAM and return to the 'sleep' mode.

After collecting data from a number of venders on a route, the data stored in the interrogator 100 is downloaded to a data collection system including a computer, for example a desktop or laptop PC (not shown), for review and analysis. The interrogator 100 may be placed into a cradle or otherwise docked directly to the computer (via cable, infrared, RF or otherwise), or the interrogator or its cradle may be provided with or connected to a modem for a dial-up connection to the computer.

In one embodiment the tag 110 is intended to be disposable. A currently-available lithium battery can last up to five years. Upon battery failure, or other failure of the tag 110, the tag 110 would be discarded and replaced with a new tag 110. Although tags are commercially available which transmit at intervals, in the preferred embodiment the tag 110 transmits only when switched out of sleep mode by the interrogator 100, to conserve battery life and thus prolong the life of the tag 110. In an alternative embodiment, the tag 100 is permanent and a separate battery is provided. The battery may be a rechargeable battery, which for example could be recharged by induction, or the battery be disposable and replaced when it nears the end of its expected life. The tag 110 may also comprise or be a component of a "microelectromechanical system" or "MEMS," having the tag identification function, data memory, mechanical power generation and storage, RF communications, coin sensing/vend actuation, and event capture as described herein. In either case the tag 110 is preferably capable of being powered by induction from the electromagnetic field generated by the interrogator 100, which also allows the interrogator 100 to effect data transfer from the tag 110 without using the power supply 114, to both conserve power and ensure that data can be recovered (where the tag 110 has a non-volatile memory) if the power source 114 fails.

Preferably the tag 110 also stores in ROM a manufacturer's or "master" key, allowing the manufacturer to operate and retrieve information (such as the identification code) when it is necessary to identify the owner/operator of the vender. Additionally, preferably the manufacturer can program the interrogator 100 to recognize (or reject) the operator key for any particular tag 110, or to reset a tag 110 so that another interrogator 100 can be initialized to the tag 110, in order to facilitate an operator selling part of a route or territory to another operator.

In a further preferred embodiment the interrogator 100 can be provided with a Global Positioning System (GPS) transponder or a Global System for Mobile communications (GSM) transponder (not shown), or any other suitable wireless positioning/communications medium, which may communicate for example over a regional cellular network, or for very wide area applications by satellite, allowing the operator to track the whereabouts of service personnel servicing the venders 2. In these embodiments the interrogator 100, which can incorporate a mobile phone, can initiate communications with a central station at predetermined intervals, or can be tasked by the central station to upload information at any time desired by the operator.

In other applications, for example for tracking revenues and other events relating to taxicabs, the device of the invention can be connected to existing counting circuitry to record events as they occur, and can upload information at desired intervals to a central station or administrator in like fashion or read by an interrogator 100 when the taxi physically returns to the central station.

The tag 110 may utilize volatile memory, in which power must be constantly applied in order for the tag to retain the data in memory. In an alternative preferred embodiment, the tag 110 comprises a non-volatile memory, for example as may be found in current EPROM, EEPROM, and FLASH technologies, which do not require a battery 114 permanently connected to the tag 110. In the latter embodiment the battery 114 may be disconnected entirely from the tag 110 whenever the switching interface 120 breaks the circuit to the tag counter input, and is reconnected by the switching interface 120 closing or the interrogator 100 tasking the tag 110 out of sleep mode. Thus, any type of memory (semiconductor, magnetic, and others), whether it retains information in the absence of applied power or requires the constant application of power, can be used in the invention.

A preferred embodiment of the invention has been described by way of non-limiting example only. Those skilled in the art will appreciate that certain modifications and adaptations may be made without departing from the scope of the invention as claimed.

The invention claimed is:

1. A switch for transmitting an electrical signal associated with a rotary coin mechanism in which a coin is conveyed about a rotational cycle, comprising a dog disposed on a pivot, being capable of being biased to each of open and closed positions and having on each side of the pivot a finger for contacting the coin in the open position or the closed position, respectively, and a contact housing positioned facing one of the fingers, whereby as the coin passes one finger it pushes the dog to the closed position, closing a circuit and generating an electrical pulse at a tracking device, the dog remaining in the closed position until the coin passes the other finger and pushes the dog to the open position with the finger remote from contacts of the contact housing.

2. The switch of claim 1 wherein the contact housing provides a pair of contacts facing a conductive finger which contacts the pair of contacts to close the circuit.

3. The switch of claim 1 wherein the dog is biased by a ball which settles into a first notch in the open position or a second notch in the closed position.

4. The switch of claim 3 wherein the ball is spring-loaded.

5. The switch of claim 1 wherein the dog is frictionally engaged to a hub.

6. The switch of claim 1 wherein the switch delivers a signal to a tracking device.

7. The switch of claim 6 wherein the coin mechanism is in a vender.

* * * * *